United States Patent [19]

Clerc

[11] Patent Number: 4,577,134

[45] Date of Patent: Mar. 18, 1986

[54] DIRECT HEATING CATHODE AND A PROCESS FOR MANUFACTURING SAME

[75] Inventor: Guy Clerc, Paris, France

[73] Assignee: Thomson-CSF, Paris, France

[21] Appl. No.: 338,872

[22] Filed: Jan. 12, 1982

[30] Foreign Application Priority Data

Jan. 16, 1981 [FR] France ..... 81 00782

[51] Int. Cl.[4] ..... H01J 1/14; H01J 19/06; H01K 1/04

[52] U.S. Cl. ..... 313/346 R

[58] Field of Search ..... 313/346 R, 352, 355

[56] References Cited

U.S. PATENT DOCUMENTS

| | | | |
|---|---|---|---|
| 3,389,977 | 6/1968 | Tarver | 313/355 X |
| 3,719,856 | 3/1973 | Koppius | 313/346 R |
| 4,002,940 | 1/1977 | Ekkelboom et al. | 313/352 |
| 4,019,081 | 4/1977 | Buxbaum et al. | 313/346 R |
| 4,143,295 | 3/1979 | Oguro | 313/346 R |
| 4,178,530 | 12/1979 | Lersmacher et al. | 313/337 |

*Primary Examiner*—William L. Sikes
*Assistant Examiner*—Robert E. Wise
*Attorney, Agent, or Firm*—Roland Plottel

[57] ABSTRACT

The invention provides a direct heating thermo-electronic emission cathode comprising a pyrolytic graphite support and an emissive coating formed of a mixture of tungsten and lanthanum oxide, the tungsten being transformed in its surface part into tungsten hermicarbide.

20 Claims, 1 Drawing Figure

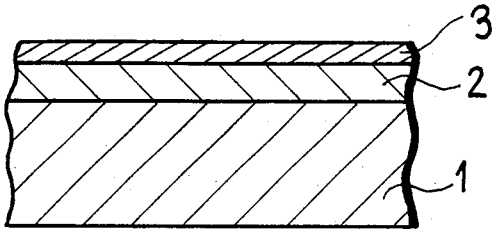
3
2
1

DIRECT HEATING CATHODE AND A PROCESS FOR MANUFACTURING SAME

BACKGROUND OF THE INVENTION

The present invention relates to a cathode for a high frequency electronic tube and more particularly to a direct heating thermo-electronic emission cathode.

In high frequency electronic tubes of the triode, tetrode or pentode type, which comprise a cathode, an anode and one, two or three grids, it is advantageous to form the grids from pyrolytic graphite, a material known for its mechanical and thermal qualities.

However, in these same tubes the cathodes are generally made from tungsten wires or thoriated tungsten wires for reasons of thermo-electronic emissivity, the operating temperature is then between 1900° and 2000° K. There then arise, during operation, mechanical problems because of the difference in thermal behaviour between the materials, which problems are imperfectly solved by means of expensive mechanical fittings. It has been proposed to avoid the thermo-mechanical problems inside the tube while ensuring good thermo-electronic emissivity by introducing direct heating from a pyrolytic graphite support and by depositing on the surface of the graphite a material emitting at a lower temperature than tungsten or thoriated tungsten such as lanthanum hexaboride $LaB_6$ for example. Such a structure allows electronic emission to be obtained at a temperature between 1400° and 1500° C. However, a drawback of emissive materials such as lanthanum hexaboride is that of their high chemical activity with respect to hot graphite, which may lead to the destruction of the cathode. For this reason it is then necessary to insert an intermediate layer between the graphite and the lanthanum hexaboride forming a diffusion barrier between these two materials.

SUMMARY OF THE INVENTION

The present invention has as its object a direct heating cathode working at the same temperature as the lanthanum hexaboride cathode but not requiring any intermediate layer between the graphite and the emissive layer.

With respect to a cathode currently used in the prior art, the principal advantages obtained are:

a lower operating temperature, better mechanical behaviour.

With respect to a lanthanum hexaboride cathode, the advantage resides in the suppression of the intermediate layer.

The cathode of the invention comprises a pyrolytic graphite support heated by Joule effect and an emissive coating formed of a mixture of tungsten and rare earth oxide (lanthanum oxide for example).

The emissive layer may be surface carburized to improve the emission.

DESCRIPTION OF THE DRAWING

Other objects, features and results of the invention will be clear from the following description accompanied by the single FIGURE of the drawing which shows a sectional view of one embodiment of the cathode of the invention.

DESCRIPTION OF THE PREFERRED EMBODIMENT

The cathode of the invention comprises a pyrolytic graphite support 1 of a thickness of about 200μ, on which there is deposited, by plasma or by cathode spraying or by any other means known to a man skilled in the art, a homogeneous layer 2 of a mixture of tungsten and lanthanum oxide, this latter being in proportions between 0.5% and 10%, the thickness of layer 2 may be between 50 and 100μ.

The tungsten of the emissive layer may be transformed in its surface part 3, over a thickness of 10 to 20μ, into tungsten hemicarbide ($W_2C$). This transformation is achieved in a usual way by heating the cathode in hydrocarbon vapors at a temperature of about 1800° C.

In another variation, the tungsten carbide may be co-deposited with the tungsten and lanthanum oxide, in amounts of 10 to 50% carbide, 0.5 to 10% lanthanum oxide, the balance being made up by tungsten. With this variation, the procedure for carburizing the tungsten may be omitted.

The cathode of the invention may be obtained by a process comprising the following steps:

(a) mixing tungsten and rare earth oxide powders, (b) pressing the mixture under a pressure of about 3 tons/cm$^2$, (c) sintering at a temperature of about 2000° C., (d) depositing the mixture by cathode spraying on a pyrolytic graphite support, (e) heating to a temperature of about 1800° C. under reduced hydrocarbon pressure.

What is claimed is:

1. A cathode assembly comprising:

(a) an emissive layer comprising tungsten and at least one rare earth oxide;

(b) a layer of pyrolytic graphite supporting the emissive layer;

(c) the emissive layer coating and intimately contacting the layer of pyrolytic graphite without the presence of an intermediate layer of a diffusion barrier, and (d) means for directly heating the support; wherein the cathode is caused to be emissive by directly heating the layer of pyrolytic graphite.

2. The cathode as claimed in claim 1, wherein the rare earth oxide forming said layer is lanthanum oxide.

3. The cathode as claimed in claim 2, wherein the upper part of said layer is formed of tungsten hemicarbide.

4. The cathode as claimed in claim 3, wherein the proportions of said rare earth oxide forming said layer are between 0.5% and 10% by weight of the mixture.

5. The cathode as claimed in claim 4, wherein the thickness of said layer is between 50μ and 100μ.

6. The cathode as claimed in claim 3, wherein the thickness of said layer is between 50μ and 100μ.

7. The cathode as claimed in claim 2, wherein the proportions of said rare earth oxide forming said layer are between 0.5% and 10% by weight of the mixture.

8. The cathode as claimed in claim 7, wherein the thickness of said layer is between 50μ and 100μ.

9. The cathode as claimed in claim 2, wherein the thickness of said layer is between 50μ and 100μ.

10. The cathode as claimed in claim 1, wherein the upper part of said layer is formed of tungsten hemicarbide.

11. The cathode as claimed in claim 10, wherein the proportions of said rare earth oxide forming said layer are between 0.5% and 10% by weight of the mixture.

12. The cathode as claimed in claim 11, wherein the thickness of said layer is between 50μ and 100μ.

13. The cathode as claimed in claim 10, wherein the thickness of said layer is between 50μ and 100μ.

14. The cathode as claimed in claim 1, wherein the proportions of said rare earth oxide forming said layer are between 0.5% and 10% by weight of the mixture.

15. The cathode as claimed in claim 14, wherein the thickness of said layer is between 50μ and 100μ.

16. The cathode as claimed in claim 1, wherein the thickness of said layer is between 50μ and 100μ.

17. A cathode assembly according to claim 1 where in said emissive layer further comprises tungsten carbide.

18. The cathode as claimed in claim 17, wherein said rare- earth oxide is lanthanum oxide.

19. The cathode as claimed in claim 18, wherein said mixture comprises 10 to 50% carbide, 0.5 to 10% rare - earth oxide, the balance being made up by tungsten.

20. The cathode as claimed in claim 17, wherein said mixture comprises 10 to 50% carbide, 0.5 to 10% rare - earth oxide, the balance being made up by tungsten.

* * * * *